US008803759B1

(12) United States Patent
Angelucci

(10) Patent No.: US 8,803,759 B1
(45) Date of Patent: Aug. 12, 2014

(54) METHOD OF INTERNAL MECHANICAL CONNECTION FOR JOINED PHASED ARRAY SECTIONS

(75) Inventor: Marc T. Angelucci, Cherry Hill, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 629 days.

(21) Appl. No.: 13/164,925

(22) Filed: Jun. 21, 2011

(51) Int. Cl.
*H01Q 1/12* (2006.01)
*H01Q 1/20* (2006.01)

(52) U.S. Cl.
CPC ... *H01Q 1/12* (2013.01); *H01Q 1/20* (2013.01)
USPC ..... 343/878; 343/702; 361/741; 29/600

(58) Field of Classification Search
None
See application file for complete search history.

(56) References Cited

U.S. PATENT DOCUMENTS

| | | | | |
|---|---|---|---|---|
| 3,303,626 | A | 2/1967 | Brigham | |
| 3,766,696 | A | 10/1973 | Totoonchie | |
| 6,894,650 | B2 * | 5/2005 | Darden et al. | 343/702 |
| 7,443,354 | B2 * | 10/2008 | Navarro et al. | 343/777 |
| 2004/0201542 | A1 * | 10/2004 | Gottl et al. | 343/912 |
| 2008/0066414 | A1 | 3/2008 | Gosling et al. | |

* cited by examiner

*Primary Examiner* — Gregory C Issing
(74) *Attorney, Agent, or Firm* — Howard IP Law Group, PC

(57) ABSTRACT

A phased array RADAR aperture assembly is formed of a plurality of support trusses arranged parallel to each other and supporting a plurality of RADAR modular aperture sections. Each of the RADAR modular aperture sections includes a modular column extending the length of the RADAR modular aperture sections and supporting the RADAR modular aperture section, wherein each of the modular column is configured to connect to a modular column of another RADAR modular aperture section in an end-to-end connection, wherein the end-to-end connection is made on the top surface of one of the plurality of support trusses and aligns two adjacent RADAR modular aperture sections with respect to each other and forms a seamless joint between the two adjacent RADAR modular aperture sections.

6 Claims, 7 Drawing Sheets

METHOD OF INTERNAL MECHANICAL CONNECTION FOR JOINED PHASED ARRAY SECTIONS

FIELD OF THE INVENTION

The present invention relates to phased array RADAR aperture assembly.

BACKGROUND

Conventional phased array RADAR apertures are generally formed by an array of RADAR elements that are secured to the perimeter frame structure of the assembly. These conventional phased array RADAR aperture structures are relatively small and the internal structural columns holding the electronics for the RADAR elements that form the entire aperture fit within the perimeter frame structure and are supported by the perimeter frame structure.

As the application of phased array RADAR systems have advanced, there have been needs for building phases array RADARs with very large apertures. These radar aperture assembly structures are so large that the internal structural columns for the RADAR elements cannot be built monolithically while spanning the full length of the RADAR aperture. The RADAR elements are constructed as several modular units that need to be connected linearly to span the full length of the RADAR aperture. However, building multiple smaller perimeter frames within the RADAR aperture structure to secure each RADAR element is not desirable because such structure would introduce structural seams within the aperture assembly that would interfere with the proper operation of the phased array RADAR.

Therefore, there is a need for connecting the RADAR elements without structural seams that would enable assembling the RADAR elements into a large phased array RADAR aperture structure.

SUMMARY OF THE INVENTION

In one aspect of the present invention, a phased array radar aperture assembly comprises at least one RADAR aperture section supported on a plurality of support trusses arranged parallel to each other, each support truss having a top surface. The RADAR aperture section comprises a plurality of RADAR modular aperture sections supported on the top surfaces of the plurality of support trusses, wherein each of the RADAR modular aperture sections comprises a modular column extending the length of the RADAR modular aperture sections and supporting the RADAR modular aperture section, wherein each of the modular columns is configured to connect to a modular column of another RADAR modular aperture section in an end-to-end connection, wherein the end-to-end connection is made on the top surface of one of the plurality of support trusses and aligns two adjacent RADAR modular aperture sections with respect to each other and forms a seamless joint between the two adjacent radar modular aperture sections. The modular columns are arranged orthogonal to the support trusses and extend between two neighboring support trusses and a plurality of connectors are affixed to the top surface of each of the support trusses, where the connectors are configured to form the end-to-end connection between two modular columns.

The end-to-end connection aligns the two RADAR modular aperture sections with respect to each other and allows the two RADAR modular aperture sections to be seamlessly joined to form the phased array RADAR aperture assembly.

BRIEF DESCRIPTION OF THE DRAWING

The present invention is best understood from the following detailed description when read in conjunction with the accompanying drawing. Like numerals denote like features throughout the specification and drawing. The drawings are schematic unless identified as otherwise and the figures are not drawn to scale. Included in the drawing are the following figures.

DETAILED DESCRIPTION

Figure 1:
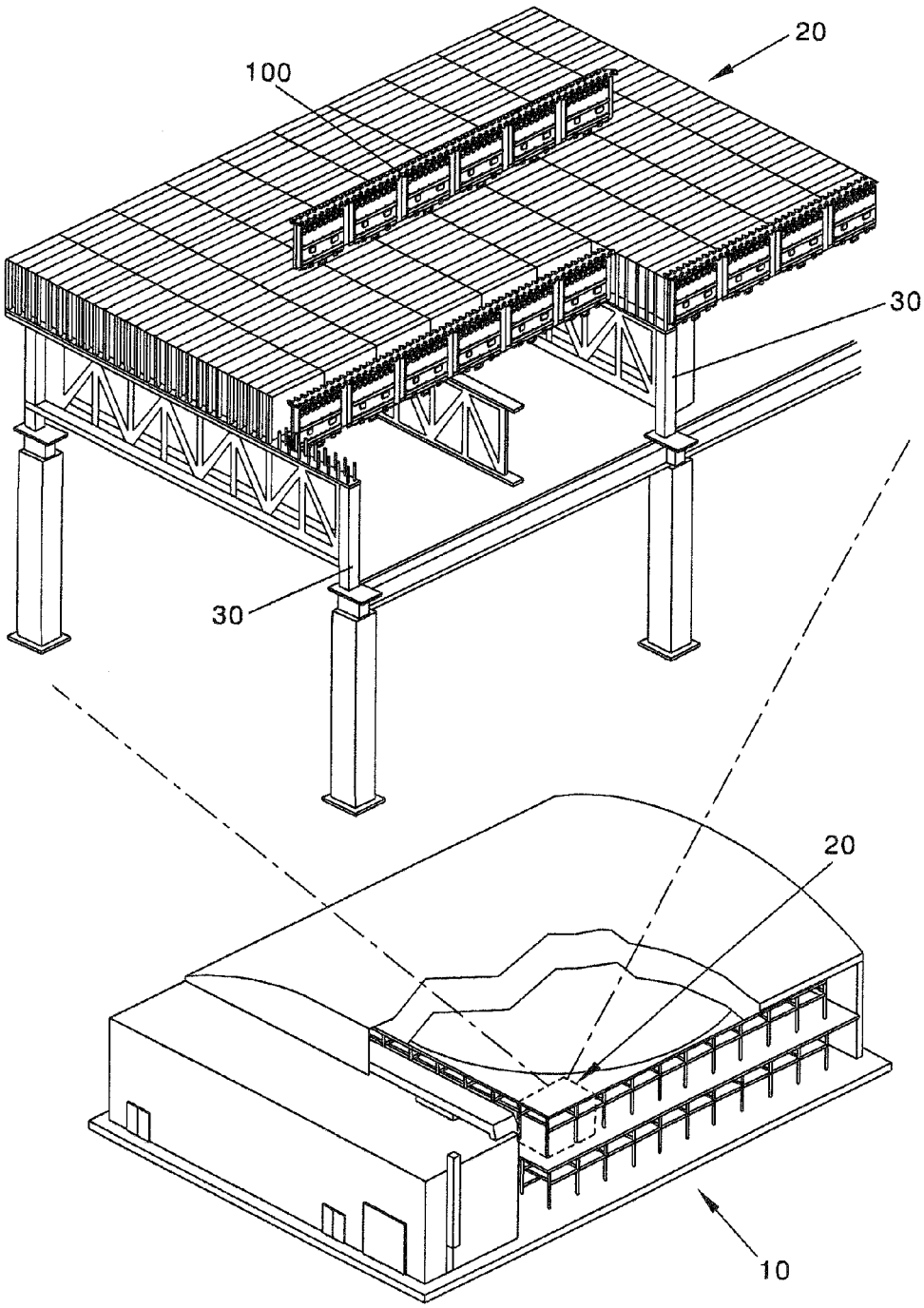
FIG. 1 shows a large phased array RADAR assembly.
Figure 2:
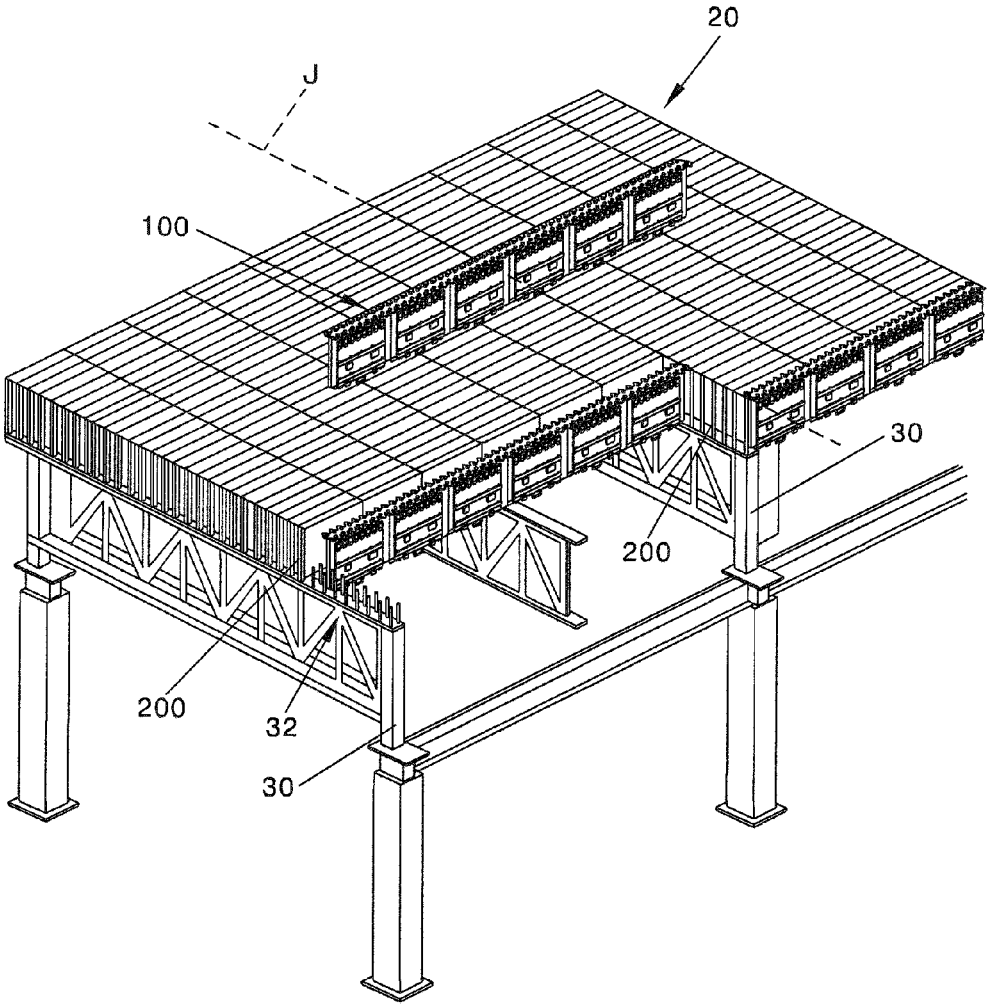
FIG. 2 shows a RADAR aperture section.

FIG. 1 is an illustration of a large phased array RADAR assembly 10. The assembly is comprised of at least one RADAR aperture section 20 supported on a plurality of support trusses 30 arranged parallel to each other. Each of the support trusses 30 has a top surface 32. Referring to a detailed view of FIG. 2, the RADAR aperture section 20 is comprised of a plurality of RADAR modular aperture sections 100 supported on the top surfaces 32 of the plurality of support trusses 30.

Figure 3:
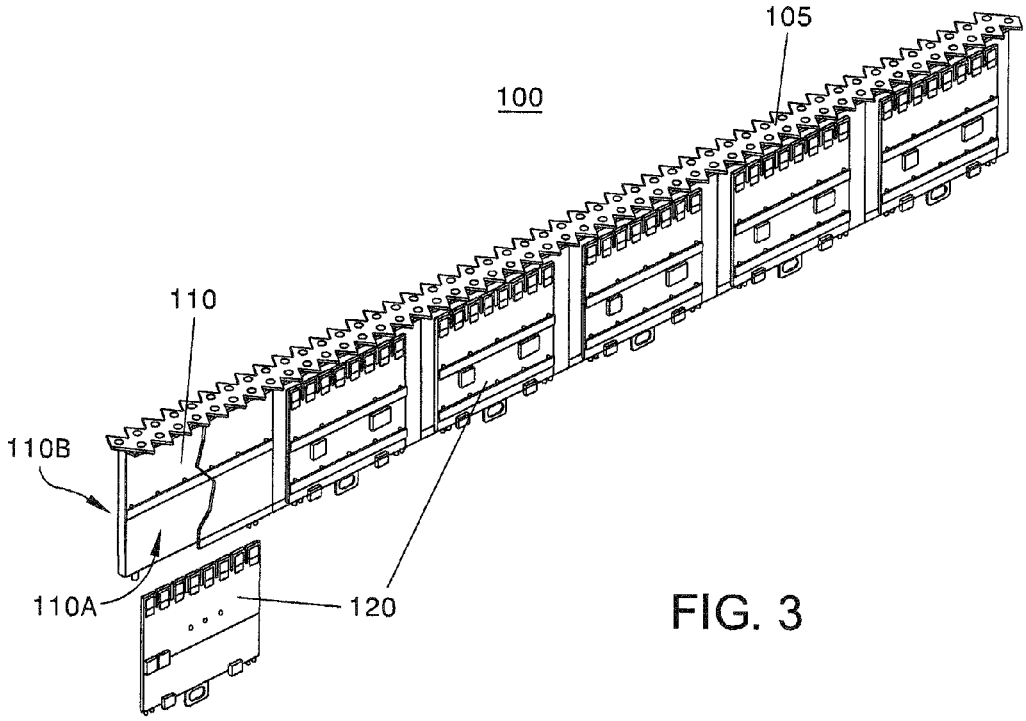
FIG. 3 is a detailed view of a modular column.

Referring to FIG. 3, each of the RADAR modular aperture sections 100 comprises a radiator board 105 on a top side thereof, and a modular column 110 extending the length of the RADAR modular aperture sections 100. The modular column 110 provides structural strength to a given RADAR modular aperture section 100 and functions as its backbone. The modular column 110 has a planar structure having two opposing elongated rectangular faces 110A, 110B extending down orthogonally from the radiator board 105. The modular column 110 can be configured to support or hold multiple active electronics provided as Line Replaceable Units or LRUs 120. The modular column 110 can be configured to hold multiple LRUs on one or both of the faces 110A, 110B. The modular column 110 itself can be provided with an internal network of channels or passages (not shown) for carrying cooling liquid so that the modular columns 110 also function as coldplates for cooling the RADAR aperture assembly.

Each of the modular columns 110 is configured to connect to a modular column of another RADAR modular aperture section in an end-to-end connection. The end-to-end connection is formed on the top surface 32 of one of the plurality of support trusses 30 and aligns two adjacent RADAR modular aperture sections 100 with respect to each other and forms a seamless joint J between the two adjacent RADAR modular aperture sections.

The modular columns 110 are arranged orthogonal to the support trusses 30 and extend between two neighboring support trusses. A plurality of connectors 200 are affixed to the top surface 32 of each of the support trusses, where the connectors 200 are configured to form the end-to-end connection between two modular columns.

Figure 4:
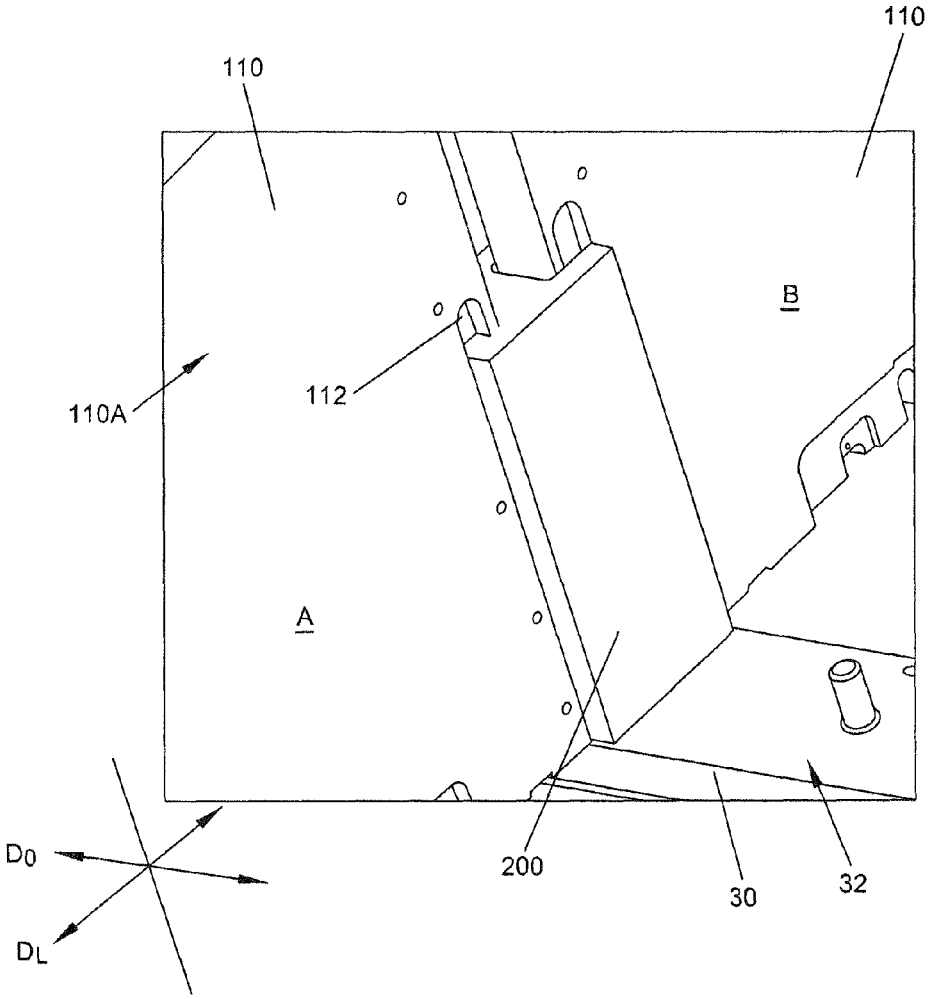
FIG. 4 is a detailed view of the end-to-end connection formed between two modular columns.
Figure 5:
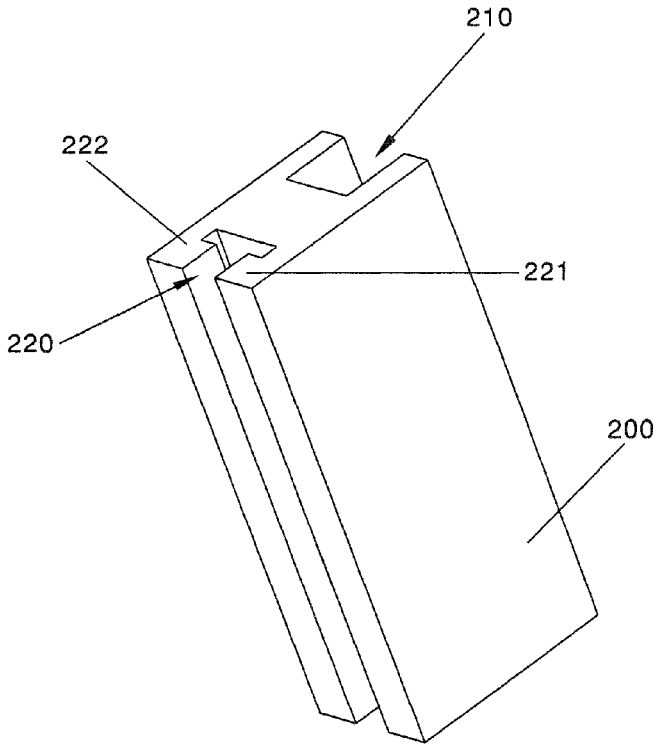
FIG. 5 is a detailed view of a connector.
Figure 6:
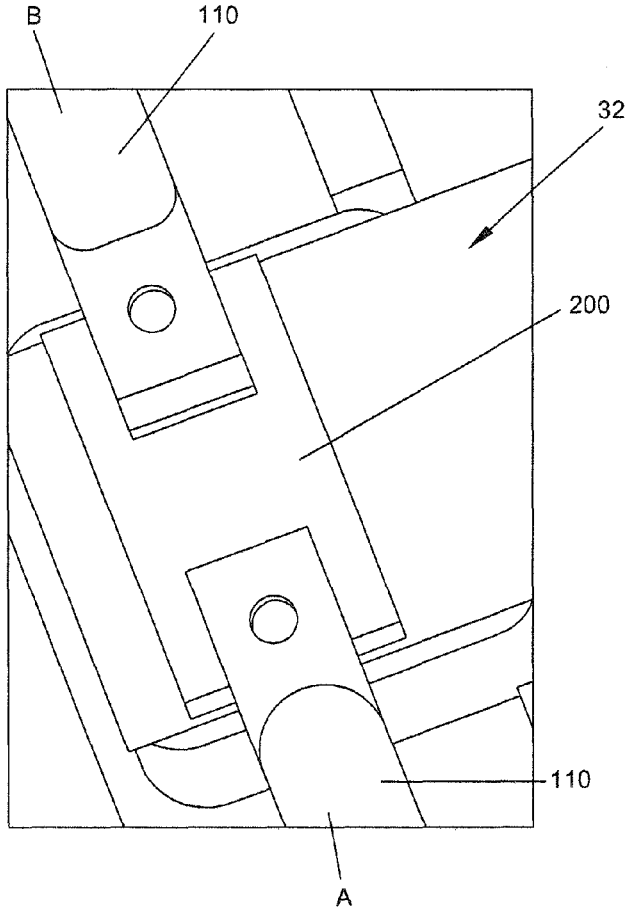
FIG. 6 is a top-down view of the structural arrangement shown in FIG. 5.
Figure 7:
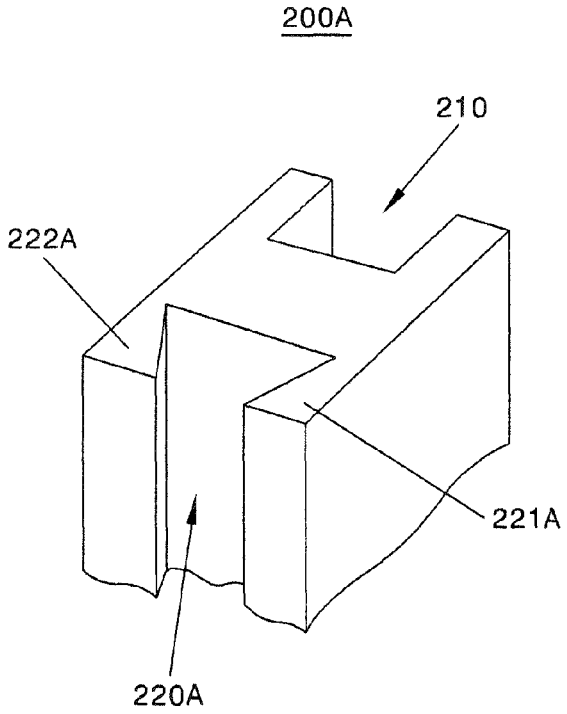
FIG. 7 shows another embodiment of the connector.

Referring to FIGS. 4-6, FIG. 4 shows a detailed view of the end-to-end connection formed between two modular columns 110 by an example of such connectors 200. FIG. 5 shows a detailed view of the connector 200. The connector 200 is affixed to the top surface 32 of a support truss 30 and joins two modular columns 110 in end-to-end configuration longitudinally, thus forming the end-to-end connection. The arrow $D_L$ in FIG. 4 denotes the longitudinal direction and the arrow $D_O$ denotes the orthogonal direction in referring to the modular columns 110.

The embodiment of the connector 200 shown in FIG. 5 is configured to form a two-sided tongue and groove sliding joint with one end of a modular column 110. This first of the two modular columns 110 joined by the connector 200 is labeled as A in FIG. 4. The first modular column A is configured with a vertically oriented groove 112 on each of the two opposing faces 110A, 110B. The connector 200 is provided with two vertically oriented opposing tongues 221, 222 that form a vertically oriented slot 220 for slidably engaging the vertically oriented grooves 112 as shown in FIG. 4. The lateral cross-sectional shape of the slot 220 formed by the opposing tongues 221, 222 is structured to prevent any lateral translation of the first modular column A once slid into the connector 200. In this example, the lateral cross-section of the slot 220 has a T-shaped structure which creates an interference between the groove 112 and the opposing tongues 221, 222 to prevent any lateral translation of the first modular column A. Here, any lateral translation refers to translation in the directions identified by the arrows $D_L$ and $D_o$ as well as all directions in between.

The opposite side of the connector 200 is configured with a guiding slot 210 extending and oriented vertically on one side of the connector 200 for receiving one end of the second modular column B. This engagement between the connector 200 and the second modular column B allows the second modular column B to translate laterally in the direction $D_L$ for accommodating thermal expansion of the structures but prevent any lateral translation in the direction $D_O$ orthogonal to the second modular column's face.

The vertically oriented opposing tongues 221, 222 of the connector 200 form a vertically oriented slot 220 that has a T-shaped cross-section as shown in FIG. 5. But the particular shape of the slot 220 is not limited to that shown. As shown by a connector 200A in FIG. 8 according to another embodiment, the opposing tongues 221A, 222A can be configured to form a dovetail-shaped vertical slot 230A. It would be readily apparent to one of skill in the art that many other shaped vertical slot can be substituted.

This description of the exemplary embodiments is intended to be read in connection with the figures of the accompanying drawing, which are to be considered part of the entire written description.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A phased array RADAR aperture assembly comprising:

a RADAR aperture section supported on a plurality of support trusses arranged parallel to each other, each support truss having a top surface;

the RADAR aperture section comprising:

a plurality of RADAR modular aperture sections supported on the top surfaces of the plurality of support trusses, wherein each of the RADAR modular aperture sections comprises a modular column extending the length of the RADAR modular aperture sections and supporting the RADAR modular aperture section, wherein each of the modular columns is configured to connect to a modular column of another RADAR modular aperture section in an end-to-end connection, wherein the end-to-end connection is formed on the top surface of one of the plurality of support trusses and aligns two adjacent RADAR modular aperture sections with respect to each other and forms a seamless joint between the two adjacent RADAR modular aperture sections;

the modular columns being arranged orthogonal to the support trusses and extending between two neighboring support trusses; and a plurality of connectors affixed to the top surface of each of the support trusses, the connectors being configured to form the end-to-end connection between two modular columns.

2. The phased array RADAR aperture assembly of claim 1, wherein the modular columns have a planar structure having two opposing elongated rectangular faces extending down orthogonally from the top surface.

3. The phased array RADAR aperture assembly of claim 2, wherein the connectors are configured to engage one end of the first of the two modular columns for preventing any lateral translation of said first modular column while engaging one end of the second of the two modular columns in a manner that allows the second modular column to translate laterally in a direction longitudinal to the modular column for accommodating thermal expansion but prevent any lateral translation in a direction orthogonal to the second modular column.

4. The phased array RADAR aperture assembly of claim 3, wherein said end of the first modular column and the connector are configured to form a two-sided tongue and groove sliding joint, wherein said end of the first modular column is provided with a vertically oriented groove on each of the two opposing faces and the connector is provided with two vertically oriented opposing tongues forming a slot for slidably engaging the vertically oriented grooves.

5. The phased array RADAR aperture assembly of claim 3, wherein said connector is also provided with a vertically oriented guiding slot for receiving said end of the second modular column.

6. The phased array RADAR aperture assembly of claim 1, wherein the modular columns are configured with internal network of channels for carrying cooling liquid and function as coldplates for cooling the RADAR aperture assembly.

* * * * *